US006276349B1

(12) United States Patent
Kofler et al.

(10) Patent No.: US 6,276,349 B1
(45) Date of Patent: Aug. 21, 2001

(54) CYLINDER-SELECTIVE CONTROL OF THE AIR-FUEL RATIO

(75) Inventors: Franz Kofler, Munich; Florian Albrecht, Unterschleissheim; Georg Meder, Munich, all of (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/414,646

(22) Filed: Oct. 8, 1999

(30) Foreign Application Priority Data

Oct. 8, 1998 (DE) ..... 198 46 393

(51) Int. Cl.[7] ..... F02D 41/14
(52) U.S. Cl. ..... 123/673; 123/687; 701/109
(58) Field of Search ..... 123/673, 687; 701/109

(56) References Cited

U.S. PATENT DOCUMENTS

| | | | | |
|---|---|---|---|---|
| 4,483,300 | * | 11/1984 | Hosaka et al. | 123/673 |
| 4,627,402 | * | 12/1986 | Saito et al. | 123/673 |
| 5,531,208 | * | 7/1996 | Hasegawa et al. | 123/673 |
| 5,548,514 | | 8/1996 | Hasegawa et al. | 701/103 |
| 5,566,071 | | 10/1996 | Akazaki et al. | 701/103 |
| 5,623,913 | * | 4/1997 | Kitajima et al. | 123/673 |
| 5,651,353 | * | 7/1997 | Allston | 123/673 |
| 5,687,699 | * | 11/1997 | Shimada et al. | 123/673 |

FOREIGN PATENT DOCUMENTS

| | | |
|---|---|---|
| 36 33 671 | 4/1988 | (DE) . |
| 38 39 611 | 5/1990 | (DE) . |

* cited by examiner

*Primary Examiner*—Tony M. Argenbright
(74) *Attorney, Agent, or Firm*—Crowell & Moring, L.L.P.

(57) ABSTRACT

Cylinder-selective control of the air-fuel ratio in a multi-cylinder internal-combustion engine is provided, wherein a lambda probe arranged in the exhaust pipe system generates a voltage signal corresponding to an air-fuel ratio. The voltage signal is supplied to a computing unit which determines the air-fuel ratio for each individual cylinder. A fuel metering unit determines a fuel injection quantity at least as a function of a basic fuel injection value and the determined air-fuel ratios of the individual cylinders, and a fuel supply unit supplies the fuel injection quantity determined by the fuel metering unit to the cylinders of the internal-combustion engine. The computing unit crank-angle-synchronously detects the voltage signal and assigns it to a certain cylinder. A voltage deviation and corresponding injection quantity correction is determined for each cylinder in relation to the voltage signals of the adjacent cylinders.

15 Claims, 2 Drawing Sheets

CYLINDER-SELECTIVE CONTROL OF THE AIR-FUEL RATIO

BACKGROUND AND SUMMARY OF THE INVENTION

This application claims the priority of German Application No. 198 46 393.6, filed Oct. 8, 1998, the disclosure of which is expressly incorporated by reference herein.

The invention relates to a cylinder-selective control of the air-fuel ratio in the case of a multi-cylinder internal-combustion engine as well as to a system for implementing such a cylinder-selective control.

It is known that a controlled catalyst operation is required for a high conversion rate of the pollutants present in exhaust gases. In this operation, the exhaust gas composition is monitored by a lambda probe and, in the event of a deviation from an air ratio $\lambda=1$, the air-fuel composition is corrected.

The lambda probe is normally installed as a sensor in the exhaust gas flow in front of the catalyst, specifically behind a junction of the exhaust pipes from the individual cylinders. As a result, the lambda probe supplies an averaged value concerning the individual cylinders. However, as a rule, mixture fluctuations between the individual cylinders are not compensated and cause a deterioration of the emissions for two reasons. On the one hand, the control frequency of the lambda control is shortened by mixture differences. This falsifies the average lambda value set by way of control parameters. On the other hand, the flows from the individual cylinders, as a rule, flow against different areas of the catalyst. As the result of the mixture differences, these areas do not operate in the optimal lambda range.

European Patent documents EP 0 670 419 A1 and EP 0 670 420 A1 describe systems for estimating the air-fuel ratio in the individual cylinders of a multi-cylinder internal-combustion engine. By means of these systems, the mixture fluctuations between the individual cylinders are taken into account. In this case, a mathematical model is developed in order to describe the system performance as a function of an output signal of a broad-band air-fuel sensor. An observation of the development of the condition of the mathematical model supplies information on the air-fuel ratio in the individual cylinders, whereupon a corresponding adjustment of the fuel-air ratio can be performed for each cylinder.

However, the above-described process requires relatively high computing expenditures and is based on the signals of broad-band lambda probes.

It is an object of the invention to provide a simple, cylinder-selective control of the air-fuel ratio in the case of multi-cylinder internal-combustion engines of the above-mentioned type, which operates reliably for a long operating period and whose development and securing expenditures are lower. In addition, a reasonable system is to be obtained.

This object is achieved by a cylinder-selective control process of the air-fuel ratio in the case of a multi-cylinder internal-combustion engine, wherein a lambda probe arranged in the exhaust pipe system generates a voltage signal corresponding to an air-fuel ratio. The voltage signal is supplied to a computing unit which determines the air-fuel ratio for each individual cylinder. A fuel metering unit determines a fuel injection quantity at least as a function of a basic fuel injection value and the determined air-fuel ratios of the individual cylinders. A fuel supply unit supplies the fuel injection quantity determined by the fuel metering unit to the cylinders of the internal-combustion engine. The computing unit crank-angle-synchronously detects the voltage signal and assigns it to a certain cylinder. A voltage deviation is determined for each cylinder in relation to the voltage signals of the adjacent cylinders. A correction of the injection quantity is carried out as a function of the voltage deviation.

The object is further achieved by a system for implementing the cylinder-selective control of the air-fuel ratio in the case of a multi-cylinder internal-combustion engine, wherein a lambda probe is provided in the exhaust pipe system for generating a voltage signal corresponding to an air-fuel ratio, a determination unit is provided to which the voltage signal is fed in order to determine the air-fuel ratio for each individual cylinder, a fuel metering unit is provided which determines a fuel injection quantity at least as a function of a basic fuel injection value and the determined air-fuel ratios of the individual cylinders, and a fuel supply unit is provided which supplies the fuel injection quantity determined by the fuel metering unit to the cylinders of the internal-combustion engine. The determination unit is constructed for (1) detecting the voltage signal in a crank-angle-synchronous manner and assigning it to a certain cylinder, (2) determining the voltage deviation for each cylinder in relation to the voltage signals of adjacent cylinders, and for (3) carrying out a correction of the injection quantity as a function of the voltage deviation.

In order to minimize mixture fluctuations between the cylinders, working-cycle-synchronous voltage fluctuations of the lambda probes selected in the form of surge probes are analyzed and are assigned to the individual cylinders. In particular, the voltage deviation of the lambda probe voltage signal of a cylinder is formed in relation to the voltage signals of the—relative to the ignition sequence—adjacent cylinders. By means of the differential value, a correction of the injection will then be made.

According to a preferred embodiment of the invention, a correction value for the injection quantity is obtained from a characteristic curve or a characteristic diagram.

In order to reduce the computing expenditures, the cylinder-individual mixture adaptation may be switched off above a defined threshold.

Preferably, two correction values per cylinder are computed for the injection quantity, for example, one term for long-period deviations and one term for short-period deviations (such as tank ventilation).

If defined conditions are met for lambda adaptation, the long-period term can form an adaptation value for the cylinder mixture adaptation and, after the engine is switched off, can be stored in the holding phase of the control unit in a non-volatile manner.

On the whole, the present invention has the advantage that a long operating period with high control precision can be used as the basis. In addition, surge probes are clearly lower in cost than broad-band lambda probes, so that generally lower development and manufacturing costs can be expected.

Other objects, advantages and novel features of the present invention will become apparent from the following detailed description of the invention when considered in conjunction with the accompanying drawings.

DETAILED DESCRIPTION OF THE DRAWINGS

Figure 1:
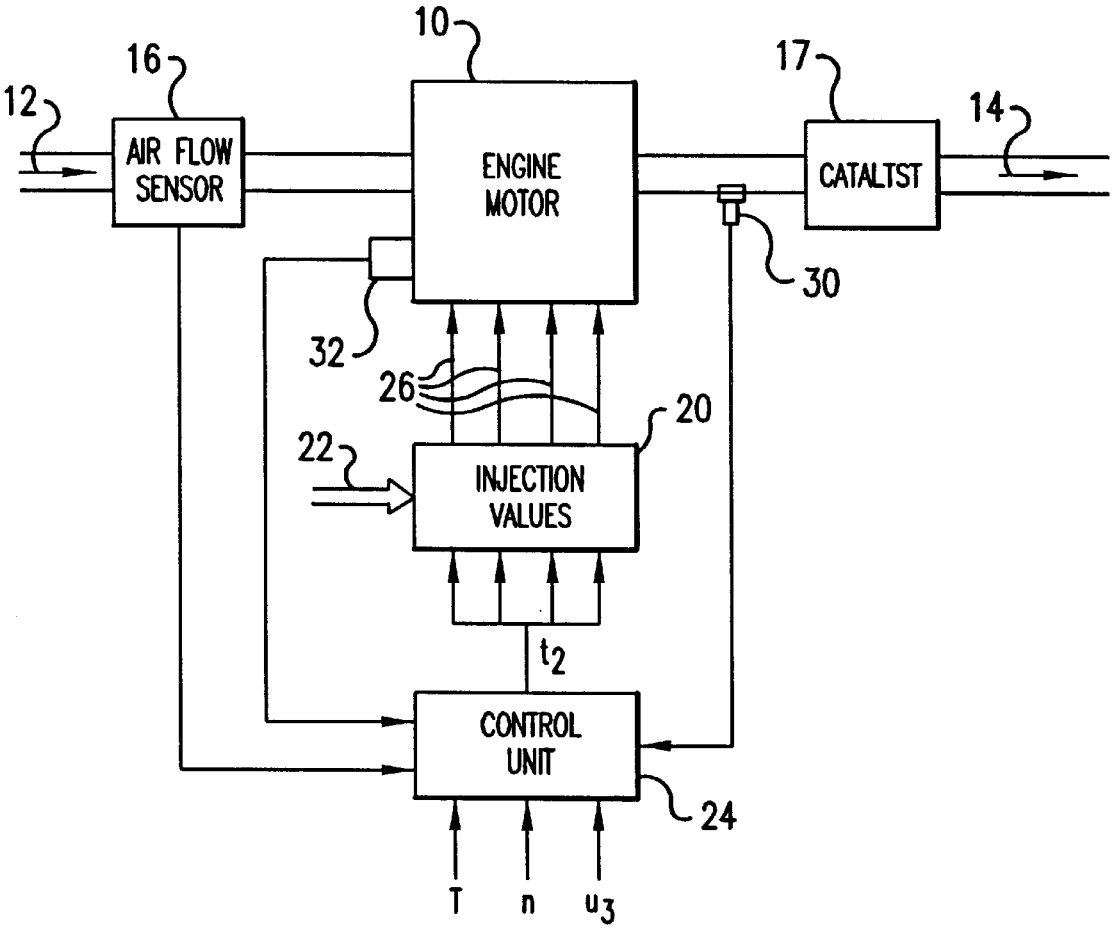
FIG. 1 is a schematic block diagram of the construction of a system for implementing the cylinder-selective control according to the present invention.

FIG. 1 illustrates a system for implementing the cylinder-selective control according to the invention. In this case, an engine 10 has a plurality of cylinders. In the present case, the engine 10 has four cylinders.

The engine 10 is supplied with air by way of an intake pipe system 12, the air flow being determined by an air flow sensor 16. A corresponding signal is emitted to a control unit 24.

The exhaust gases of the engine are removed into the environment by way of an exhaust pipe system 14.

In the exhaust pipe system, a catalyst 18 is provided for converting the pollutants into non-toxic substances. Between the engine 10 and the catalyst 18, a lambda probe 30 is arranged. The lambda probe 30 is constructed as a surge probe. The lambda probe 30 emits a voltage signal, which corresponds to the exhaust gas composition, to the control unit 24. In the case of a lean mixture ($\lambda>1$), the probe voltage amounts, for example, to about 100 mV. In the range $\lambda=1$, the probe voltage changes almost in a surge-type manner, and, in the case of a rich mixture ($\lambda<1$), reaches values of 800 mV or more. Specifically the intense change of the probe voltage in the range $\lambda=1$ permits the detection of even minimal deviations from the optimal air-fuel ratio. The present invention is based on the fact that, although the surge is manifested by a fast voltage rise, it is not manifested by a purely rectangular surge characteristic. In addition, it is known that surge probes are very reliable and reasonable in cost.

In the present case, the control unit 24 also receives temperature values T of the coolant, rotational speed values n concerning the rotational speed of the engine, as well as an operating voltage $U_B$.

Since, in the present invention, the voltage fluctuations of the lambda probes are analyzed and assigned to the individual cylinders, it is necessary that the momentarily existing working cycle of each cylinder be known. For this purpose, a crankshaft sensor 32 is used in the existing signal. The signals of the crankshaft sensor 32 are also supplied to the control unit 24.

On the basis of the existing information, the control unit 24 computes an injection time $t_i$ for each cylinder and transmits it to the injection valves 20. The injection valves 20 supply the fuel obtained from the fuel supply 22 by way of lines 26 corresponding to the injection time $t_i$ to the cylinders operating in the engine 10.

The control unit 24 first computes an injection time for each cylinder on the basis of the data available to the control unit, such as the temperature T, the rotational speed n and the air flow signals, and generates a basic injection time ti_zyl_z, wherein the letter z is a defined cylinder. For this basic injection time, a cylinder-specific mixture adaptation is then computed, specifically from the difference of two—relative to the ignition sequence—adjacent cylinders.

Figure 2:
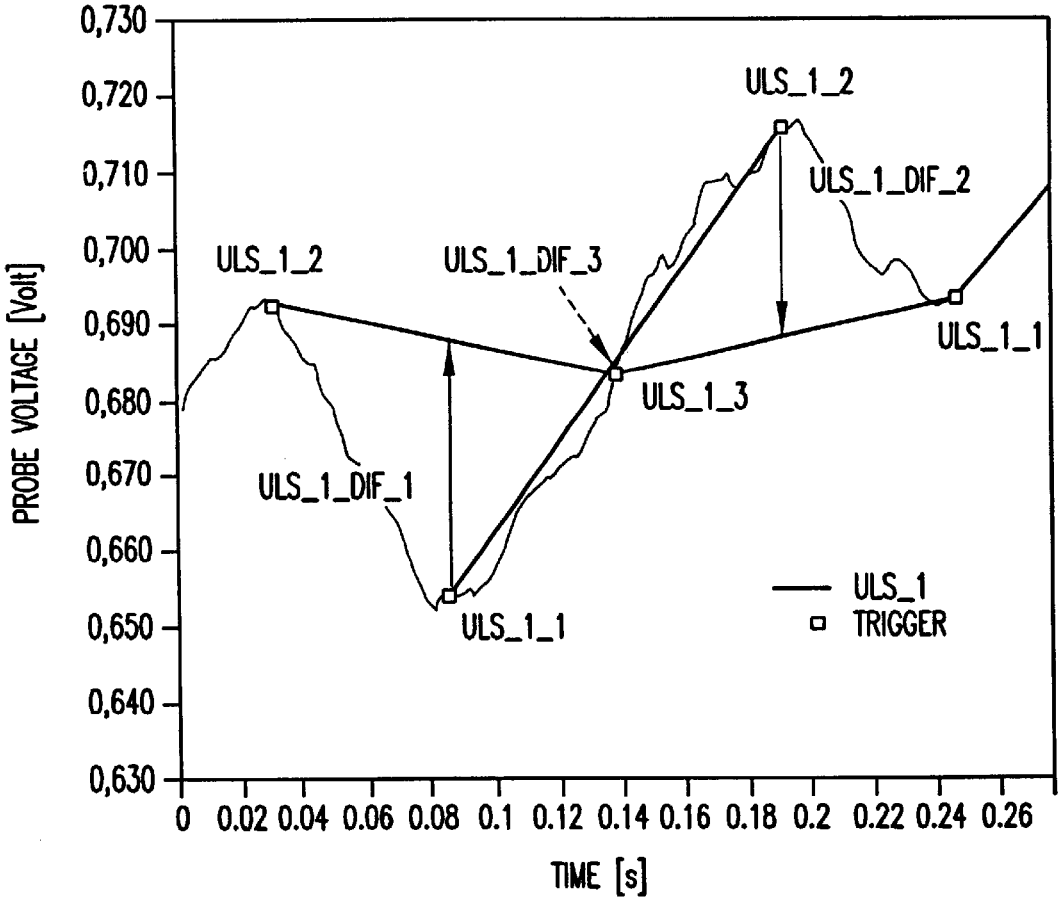
FIG. 2 is a time-voltage diagram of a lambda surge probe.

This will be explained in the following by way of FIG. 2. FIG. 2 illustrates a probe voltage signal ULS_1_z over time s. In the course of the voltage, the probe voltage is indicated for different cylinders z.

The voltage deviation of a cylinder z is now calculated on the basis of the voltage values of the cylinders, which are adjacent relative to the ignition sequence. The voltage difference for the first cylinder (z=1) ULS_1_diff_1 is calculated as follows:

$$ULS_1_diff_1=((ULS_1_3+ULS_1_2)/2)-ULS_1_1.$$

In this case, ULS_1_z is the probe voltage at the z-th cylinder. The differences ULS_1_diff_z at the other cylinders are calculated correspondingly.

Corresponding to the determined voltage deviation, an injection correction KF_ti_zyl_z is obtained from a characteristic curve. The basic injection time ti_zyl_z is corrected by means of this correction injection time.

If the conditions for lambda adaptation have been met, an adaptation value of the cylinder mixture adaptation is formed and is stored in a non-volatile manner.

On the whole, the present invention provides simple cylinder-selective control at reasonable cost.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cylinder-selective control process for an air-fuel ratio of a multi-cylinder internal-combustion engine, wherein a lambda probe arranged in an exhaust pipe system generates a voltage signal corresponding to an air-fuel ratio, said voltage signal being supplied to a computing unit which determines the air-fuel ratio for each individual cylinder, a fuel metering unit being provided to determine a fuel injection quantity at least as a function of a basic fuel injection value and the determined air-fuel ratios of the individual cylinders, and a fuel supply unit being provided for supplying the fuel injection quantity determined by the fuel metering unit to the individual cylinders of the internal-combustion engine, the process comprising the acts of:

detecting the voltage signal from the lambda probe in a crank-angle-synchronous manner via the computing unit;

assigning the detected voltage signal to a certain cylinder;

determining a voltage deviation for each cylinder in relation to the voltage signals assigned to sequentially adjacent cylinders; and correcting the fuel injection quantity as a function of the determined voltage deviation.

2. The cylinder-selective control process according to claim 1, further comprising the act of obtaining a correction value for the fuel injection quantity from one of a characteristic curve and characteristic diagram.

3. The cylinder-selective control process according to claim 1, wherein the lambda probe is a surge probe.

4. The cylinder-selective control process according to claim 2, wherein the lambda probe is a surge probe.

5. The cylinder-selective control process according to claim 1, further comprising the act of no longer correcting the fuel injection quantity above a defined engine rotational limit speed.

6. The cylinder-selective control process according to claim 2, further comprising the act of no longer correcting the fuel injection quantity above a defined engine rotational limit speed.

7. The cylinder-selective control process according to claim 3, further comprising the act of no longer correcting the fuel injection quantity above a defined engine rotational limit speed.

8. The cylinder-selective control process according to claim 1, wherein two correction values for the fuel injection quantity are computed per cylinder.

9. The cylinder-selective control process according to claim 2, wherein two correction values for the fuel injection quantity are computed per cylinder.

10. The cylinder-selective control process according to claim 3, wherein two correction values for the fuel injection quantity are computed per cylinder.

11. The cylinder-selective control process according to claim 5, wherein two correction values for the fuel injection quantity are computed per cylinder.

12. The cylinder-selective control process according to claim 1, wherein correction values are stored in a non-volatile manner.

13. The cylinder-selective control process according to claim 8, wherein correction values are stored in a non-volatile manner.

14. A system for implementing cylinder-selective control of an air-fuel ratio in a multi-cylinder internal-combustion engine, comprising:

a lambda probe provided in an exhaust pipe system, said lambda probe generating a voltage signal corresponding to an air-fuel ratio;

a determination unit receiving the voltage signal from the lambda probe, said determination unit determining the air-fuel ratio for each individual cylinder of the multi-cylinder internal-combustion engine;

a fuel metering unit determining a fuel injection quantity at least as a function of a basic fuel injection value and the determined air-fuel ratios of the individual cylinders;

a fuel supply unit supplying the fuel injection quantity determined by the fuel metering unit to the individual cylinders of the internal-combustion engine; and wherein said determination unit includes means for detecting the voltage signal in a crank-angle-synchronous manner and assigning said detected voltage signal to a certain cylinder, means for determining a voltage deviation for each cylinder in relation to the voltage signals of sequentially adjacent cylinders, and means for carrying out a correction of the fuel injection quantity as a function of the voltage deviation.

15. A software product for controlling a system which implements cylinder-selective control of an air-fuel ratio in a multi-cylinder internal-combustion engine, comprising:

a computer readable medium having stored thereon program code segments that:

detect a voltage signal received from a lambda probe in a crank-angle-synchronous manner;

assign the detected voltage signal to a certain cylinder;

determine a voltage deviation for each cylinder of the multi-cylinder engine in relation to the detected voltage signals assigned to sequentially adjacent cylinders; and correct a fuel injection quantity value as a function of the determined voltage deviation.

* * * * *